US006622879B1

(12) United States Patent
Carter

(10) Patent No.: US 6,622,879 B1
(45) Date of Patent: Sep. 23, 2003

(54) APPARATUS AND METHOD FOR THE TRANSFER OF MATERIAL BETWEEN VESSELS

(75) Inventor: Glen A. Carter, Mattoon, IL (US)

(73) Assignee: Justrite Manufacturing Company, L.L.C., Des Plaines, IL (US)

( * ) Notice: Subject to any disclaimer, the term of this patent is extended or adjusted under 35 U.S.C. 154(b) by 7 days.

(21) Appl. No.: 10/092,118

(22) Filed: Mar. 6, 2002

(51) Int. Cl.[7] ..... B65D 6/00

(52) U.S. Cl. ..... 220/23.4; 220/23.83; 306/356

(58) Field of Search ..... 220/23.4, 23.2, 220/23.83, 4.27; 206/386

(56) References Cited

U.S. PATENT DOCUMENTS

| | | | | |
|---|---|---|---|---|
| 396,619 A | | 1/1889 | Smith | |
| 986,395 A | | 3/1911 | King | |
| 1,732,505 A | | 10/1929 | Dawson | |
| 2,938,644 A | * | 5/1960 | Cavalier et al. | 220/584 |
| 3,080,096 A | * | 3/1963 | Carfizzi | 222/143 |
| 3,170,590 A | * | 2/1965 | Ullman et al. | 220/776 |
| 3,304,950 A | | 2/1967 | Hubert | |
| 3,389,830 A | * | 6/1968 | Smith | 206/504 |
| 3,460,899 A | * | 8/1969 | Miller | 422/300 |
| 3,539,071 A | * | 11/1970 | Ludder | 220/23.4 |
| 3,544,022 A | * | 12/1970 | Jones et al. | 220/23.4 |
| 3,857,342 A | | 12/1974 | Johns | |
| 4,062,301 A | | 12/1977 | Pitchford | |
| 4,095,769 A | | 6/1978 | Fengels | |
| 4,694,962 A | | 9/1987 | Taub | |
| 4,838,178 A | | 6/1989 | Chriske et al. | |
| 4,862,909 A | | 9/1989 | Kim | |
| 4,930,632 A | | 6/1990 | Eckert et al. | |
| 5,007,557 A | | 4/1991 | Spence | |
| 5,020,667 A | | 6/1991 | Bush | |
| 5,036,976 A | | 8/1991 | Sechler et al. | |
| 5,092,251 A | | 3/1992 | Hamaker et al. | |
| 5,147,039 A | | 9/1992 | Sechler et al. | |
| 5,199,457 A | | 4/1993 | Miller | |
| 5,249,699 A | | 10/1993 | Williams | |
| 5,254,798 A | | 10/1993 | Zoback | |
| 5,307,931 A | | 5/1994 | Gillispie et al. | |
| 5,310,063 A | | 5/1994 | Skolasinski | |
| 5,359,955 A | | 11/1994 | Grebenyuk | |
| 5,392,911 A | | 2/1995 | Gillispie et al. | |
| 5,429,236 A | | 7/1995 | Evans | |
| 5,492,158 A | | 2/1996 | Haag | |
| 5,511,573 A | | 4/1996 | Corte | |
| 5,562,047 A | | 10/1996 | Forney et al. | |
| 5,642,834 A | | 7/1997 | Shaw et al. | |

FOREIGN PATENT DOCUMENTS

| | | |
|---|---|---|
| EP | 0 303 264 A2 | 2/1989 |
| GB | 1125001 | 8/1968 |
| JP | 6 199335 | 7/1994 |

* cited by examiner

*Primary Examiner*—Joseph M. Moy
(74) *Attorney, Agent, or Firm*—Leydig Voit & Mayer, Ltd.

(57) ABSTRACT

An apparatus and method for fluidly connecting vessels are provided. Apertures may be provided in the walls of vessels to be joined. The apparatus includes a tube with a plurality of ends, each of which is passed through an aperture disposed in a vessel wall. The apparatus may also include grommets to facilitate sealing of the apertures around the tube ends, and a clip for structurally connecting joining adjacent vessels to prevent their separation.

21 Claims, 7 Drawing Sheets

APPARATUS AND METHOD FOR THE TRANSFER OF MATERIAL BETWEEN VESSELS

FIELD OF THE INVENTION

This invention generally relates to an apparatus and method for the transfer of material between vessels, and specifically, for facilitating transfer of hazardous material between spill-control accumulation centers.

DESCRIPTION OF THE PRIOR ART

Pallet-type accumulation centers are often used for collecting hazardous material spillage or seepage from storage drums. Such accumulation centers may comprise open tub-like vessels, often with a grate spanning the top of each vessel and supported by the vessel sidewalls such that storage containers or drums sit atop the grate, and any hazardous material seepage or spillage flows into the vessel. For example, the Gator™ line of Accumulation Centers, produced by the Justrite Manufacturing Company, and other similar vessels collect storage drum spillage or seepage in this way. The utility of such centers or vessels may be enhanced by providing for the transfer of the collected material between multiple vessels. Increased spill collecting capacity and increased efficiency permit safe handling of multiple drums with lower profile vessels. However, many of the existing transfer systems or devices are complex and costly: they may often require costly special manufacturing in anticipation of such use. For example, U.S. Pat. No. 5,562,047, to Forney et al. ("the '047 patent"), describes a module connection assembly that physically connects two spill deck modules together and provides for fluid transfer between the modules.

This type of design relies on a seal created by the interaction of fasteners, washers, and the inside walls of the vessels. Specifically, as shown in FIG. 6 of the '047 patent, flanged hex nuts 66 and 66' are threaded onto the ends of connection member 58 and tightened until a seal is created between the inside surface of the vessel wall and the nut flange. The resulting seal is perpendicular to the connection member and, therefore, introduces a potential for leakage if the vessels are jostled or moved relative to each other. Specifically, relative motion between the vessel aperture and the connection member, due to vibration, minor impacts and jostling, may create a gap between the vessel wall and the flange of the hex nut causing a leak in the seal. Additionally, any deflection of the vessel sidewalls, due to the weight of containers supported thereby, may induce relative motion between the sidewall and the nut flange, thus potentially misaligning the sidewall aperture and the nut flange enough to create a leak. This potential for leakage may be magnified as heavy containers or drums are shifted or rolled from one connected vessel to another.

Moreover, this type of threaded tube design both structurally joins two vessels and provides for fluid communication between them. Such a design requires the selection of a single localized position on each vessel that is conducive to both fluid communication and structural support. As a result, the effectiveness and versatility of such a device may be limited by the potential for malfunction or leakage caused by inappropriate mounting in a location that does not support both fluid transfer and effective structural connection.

For example, if this type of design is utilized with slightly angled vessel sidewalls, or sidewalls with small external protrusions on one or both of the respective mating sidewalls, the sidewalls may not flushly mate in the location of the connection device. Under these conditions, tightening the nuts applies a concentrated force that tends to deflect the surface of the spaced-apart sidewalls in this region, thus breaking the seal. Assuming that a seal can be generated, however, such a seal is also susceptible to leakage if the vessels are moved, jostled or exposed to vibration. The lack of lateral support or structure in the flange nuts may thus tend to allow undesirable deflection of the vessel sidewalls.

Moreover, multi-component transfer systems, such as that described in the '047 patent, are not universally applicable. Specifically, such a threaded connection member must include some sort of backing member, against which a mating nut can be tightened to provide a seal. A vessel sidewall may provide a suitable backing if it is parallel to the nut flange. However, if the sidewalls of vessels to be joined are not both parallel to each other, and normal to the connection member, for example, this type of connection member may introduce concentrated, leak-inducing stresses and sidewall deflection, as discussed above. Thus, a structural connection member that can better manage such forces and stresses is desirable.

Additionally, a location that supports an effective structural connection may not coincide with the desired fluid connection location. It may be advantageous, for example, to position the connection member near the bottom of a vessel to provide for earlier communication of accumulated material. This may be due to environmental concerns regarding storage of volatile materials in open vessels or the difficulty of moving various storage devices. Locating the apertures near the bottoms of connected vessels provides a flowpath that facilitates near-complete removal of the accumulated material from both vessels. However, the configuration of the vessels may not always facilitate or support an efficient structural connection in the same location as the fluid connection. For example, it may be difficult to use a nut-tightening tool near the bottom of the vessel where there is little tool clearance. The types of connection devices described above cannot avoid this problem.

Furthermore, a rigid connection member, as in the prior type of design, will not provide an effective seal if the vessels to be joined are slightly vertically staggered. For example, a vessel may rest on a pedestal, or an uneven shop floor, such that it is otherwise vertically offset from a joined vessel. In this case, the rigidity of the vessel walls and of the connection member will prevent an effective seal at their interface, particularly if the uneven surface forces the connection member into a non-perpendicular relationship with the sidewalls. The interface between rigid nut flanges and vessel walls, in this case, is subject to the same sealing problems inherent in a perpendicularly-sealing interface between the vessel walls and the connection device, as described above. Moreover, utilizing mass-produced, multi-component systems including independently manufactured apertures, connection members, and flange nuts also introduces inherent build variations or tolerances that exacerbate these issues.

Also, threaded metal connectors may be susceptible to corrosion, which increases the possibility of leaks and the time and effort needed to remove or disassemble such connectors. The fabrication of complex devices, such as those including threaded tubes and nuts, also results in a complex, costly connection method that may be difficult to integrate with containers that do not have smooth surfaces surrounding the connection apertures. Specifically, securing a nut to a threaded connection member requires adequate clearance from walls or other internal features of the vessel to allow the use of a wrench, socket, or other tool during installation. Additionally, transfer systems incorporating a threaded connection member secured by nuts can loosen and cause leakage over time, particularly if exposed to vibration and changes in temperature.

Thus, a need exists for a secure, low-cost vessel connection apparatus and method that provides a leak proof seal, is simple to install, is corrosion resistant, and which may dissipate applied forces along a vessel wall, thus reducing vessel wall deflection and relative motion between vessel sidewalls and fluid connection members.

OBJECTS OF THE INVENTION

Accordingly, it is an object of this invention to provide a transfer apparatus that facilitates the transfer of materials between vessels, and that provides and maintains a flexible, leak-proof seal and a secure connection between the vessels, particularly if they are moved or jostled relative to one another, or if the joined vessels rest on a slightly uneven surface.

Another object of the invention is to decrease the potential for leakage of a fluid connection between vessels that does not, in addition, structurally connect the vessels.

It is a further object of the invention to provide an inherently corrosion-resistant apparatus for the transfer of material between vessels.

An additional object of the invention is the provision of a holding device that securely holds together vessels fluidly connected by the transfer apparatus of the invention, and that may be positioned independently of the transfer apparatus, so that sidewall stresses may be reduced, particularly in the area of the fluid connection.

Additionally, it is an object of this invention to provide such an apparatus that is easy to install and that has a very low cost.

Another object of the invention is to provide a method for fluidly connecting vessels that fulfills all of the above-stated objectives.

BRIEF DESCRIPTION OF THE INVENTION

To fulfill the stated objects, among others, an invention and method are disclosed herein that provide for collection and controlling of the accumulation of materials within a plurality of vessels. Specifically, the invention provides an apparatus that includes a tube of sufficient length, with an outer wall and a plurality of ends that extend through apertures in the sidewalls of vessels to be fluidly connected, such that the tube provides a flow path for material between the interiors of the vessels. The tube may consist of a rigid material that also prevents adjacent vessels from separating due to forces acting on one or both of the vessels, in a direction transverse to the longitudinal axis of the tube. Moreover, the length of the tube may be selected in order to provide a desired level of rigidity in this direction. The invention may also include a sealing interface between at least two portions of the tube outer wall and at least two vessel apertures. The sealing interface may further be substantially coaxial with the tube at each sealed interface. Moreover, the apertures may also be provided at various depths of the vessels, to facilitate fluid transfer at corresponding vessel fill levels.

In order to provide or enhance a leak-proof seal, the sealing interface of the apparatus may comprise a grommet to be disposed in a vessel sidewall aperture before the respective tube end is inserted. The grommet may provide multiple sealing surfaces, viz., one coaxial seal between the tube and the aperture, and additional seals on each of the interior and exterior surfaces of the vessel sidewall in the immediate vicinity of the aperture. The apparatus may also include at least one C-shaped channel member, or clip, that straddles and grips the top edges of substantially abutting sidewalls of adjacent vessels, thus preventing their separation due to forces acting on one or both of the vessels, in the direction of the longitudinal tube axis. Moreover, the clip may include one or more tabs protruding into its interior, to resist removal from the abutting sidewalls once installed. The clip may also be a separate component from the tube, capable of placement separately from the tube.

Moreover, each of the components of the apparatus may be manufactured of a material that resists corrosion or attack by hazardous substances. The tube may also be at least partially fabricated of a lubricious substance that facilitates ease of insertion into the grommets, or the tube wall may be at least partially coated with a lubricious substance.

The method of the presently described invention may consist of the steps necessary to provide the transfer apparatus described above, and an additional step of determining a depth at which the material transfer is desirable.

DETAILED DESCRIPTION OF THE INVENTION

As discussed above, the invention provides an apparatus and a method for a secure, low cost, leak-proof, corrosion-resistant structural and fluid connection between vessels, particularly an apparatus and a method that provide these benefits at a low cost.

Figure 1:
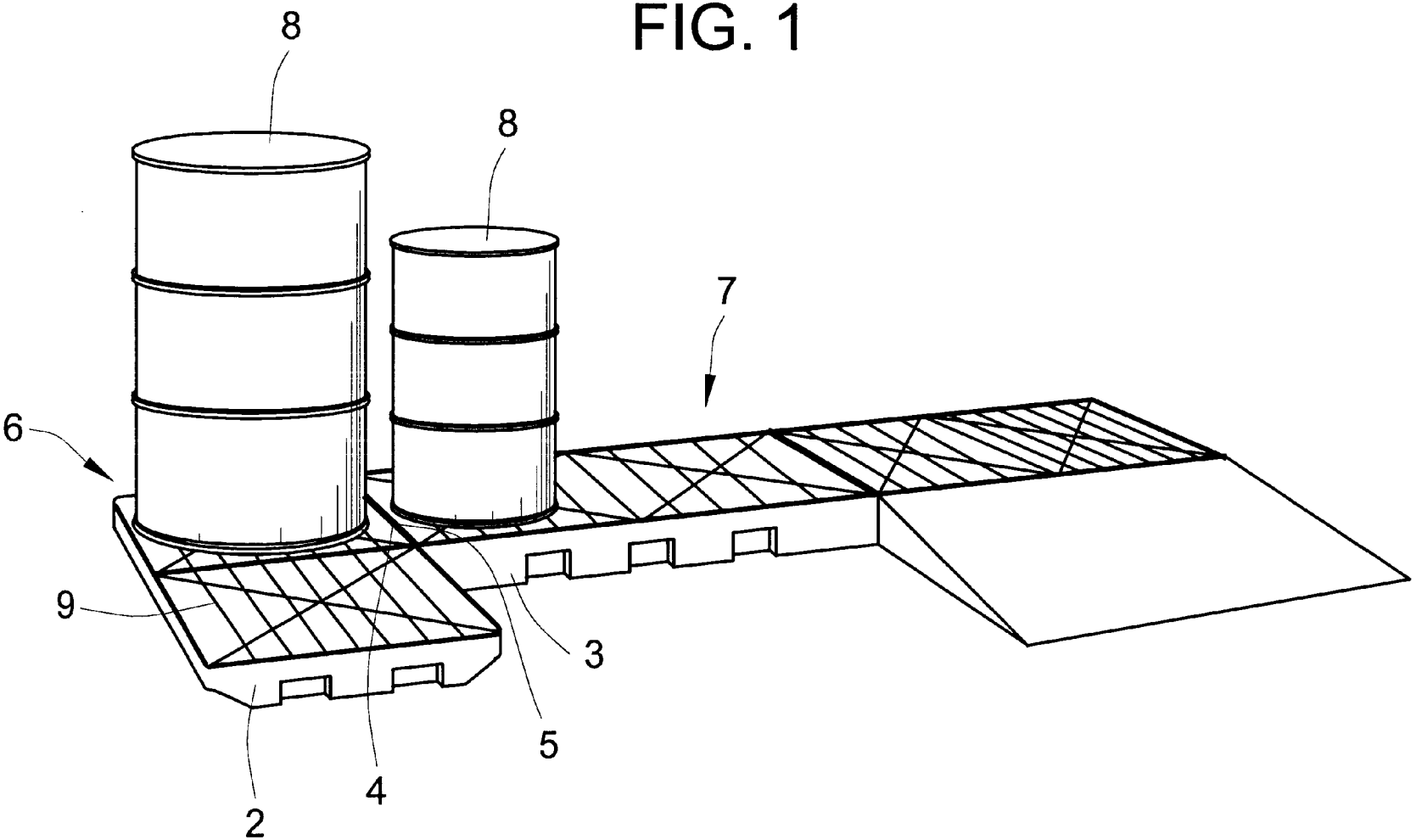
FIG. 1 is a perspective view of hazardous material storage vessels fluidly connected by the combination and method of the invention described herein.
Figure 3:
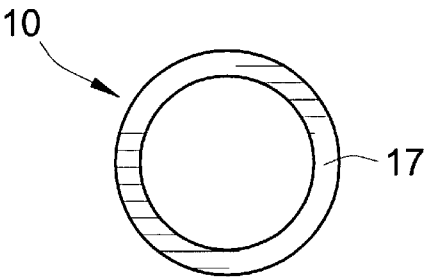
FIG. 3 is an end view of the tube component of the present invention, which is shown in FIG. 2.

Specifically, an embodiment of the apparatus of the invention provides a fluid connection between two vessels 2, 3, with upright sidewalls 4, 5 that define interiors 6, 7 as shown in FIG. 1. This embodiment is particularly directed to fluidly connecting vessels made by The Justrite Manufacturing Company, specifically its Gator™ Accumulation Centers, but may also be used with other similar vessels. These vessels may be hazardous material containment accumulation centers or pallets. Containers or drums 8 of hazardous materials are often stored either in such vessels 2, 3, or on grates 9 spanning the open tops of such vessels 2, 3, as shown in FIG. 1, such that leaking material flows into, and is collected, accumulated, and controlled by the connected vessels 2, 3. Of course, the inventive scope of the presently discussed apparatus and method contemplates use with many types of vessels other than the specific accumulation centers described herein. The fluid communication between vessels connected according to the teachings of this invention may expand the containment and storage capacity of similar types of vessels connected to one another in this way.

Figure 5:
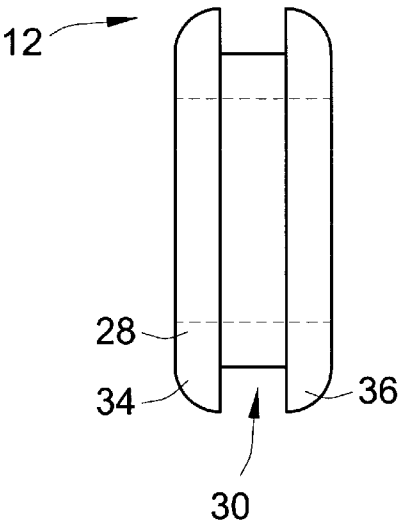
FIG. 5 is a side view of the grommet component of the present invention, which is shown in FIG. 4.
Figure 2:
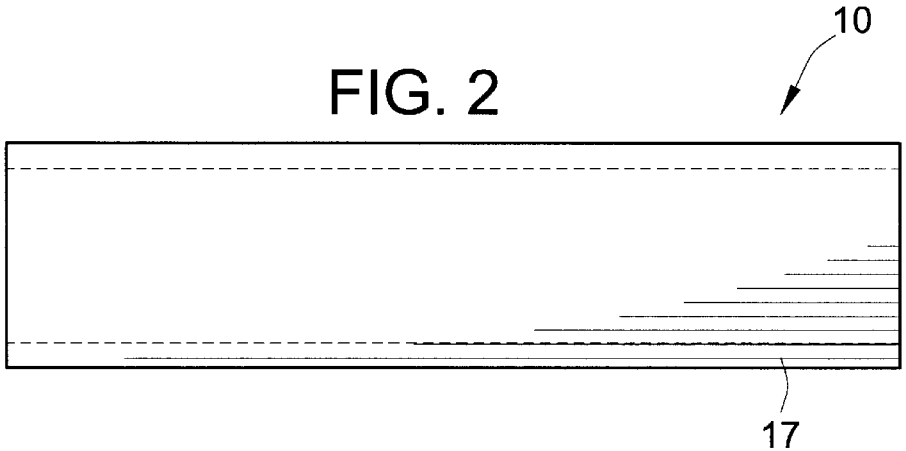
FIG. 2 is a plan view of the tube component of the apparatus of the present invention.
Figure 6:
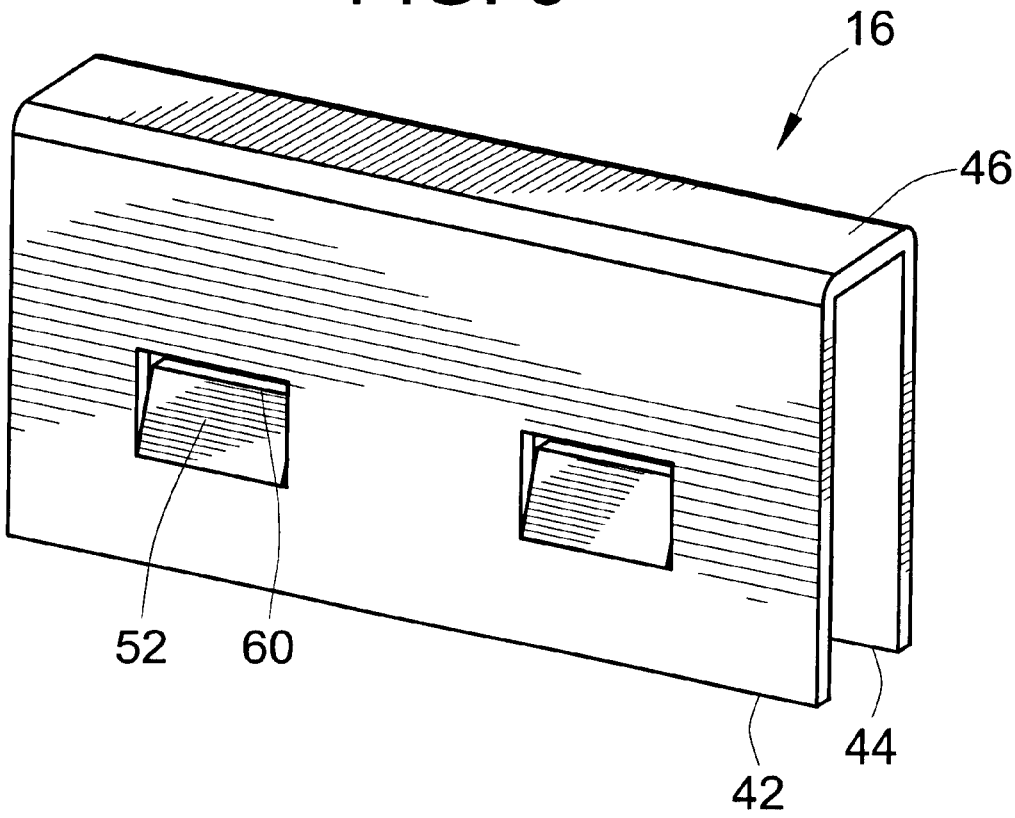
FIG. 6 is a perspective view of the clip component of the present invention.
Figure 10:
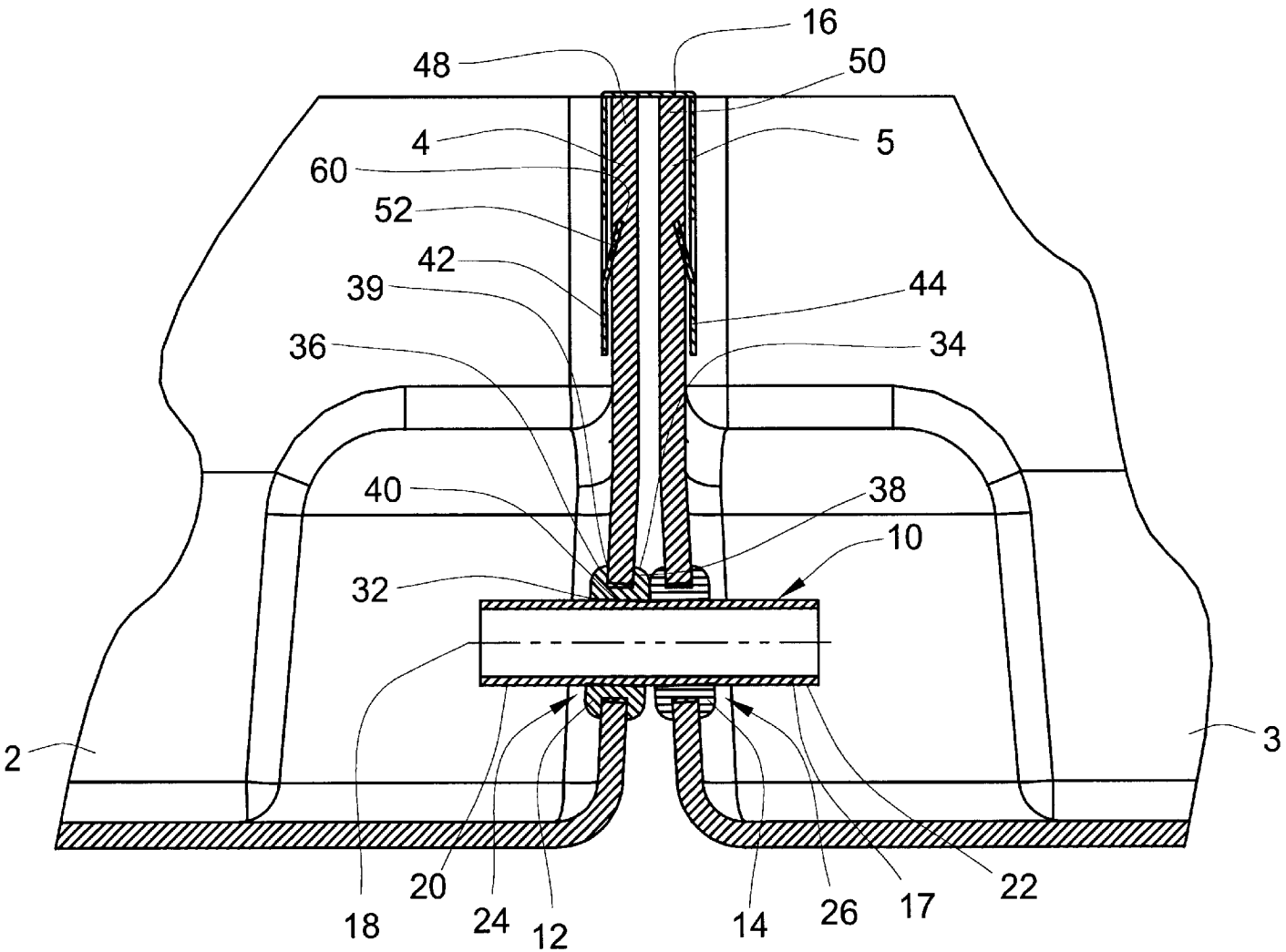
FIG. 10 is a sectional view, along line 10—10 of FIG. 9, showing two vessels fluidly and structurally connected according to the teachings of an embodiment of the present invention.

The constituent elements of the apparatus of the present invention may include: a tube 10, two grommets 12, 14, of which the grommet 12 is representative, and one or more clips 16, illustrated in FIGS. 2, 5 and 6, respectively. Alternatively, the apparatus may be provided without grommets. That is, the apparatus of the present invention may include only a tube 10, and one or more clips 16, particularly if the tube 10 incorporates a sealing interface or sealing structure, as described in greater detail below. As shown in FIG. 10, to provide fluid communication between adjoining vessels 2, 3, an embodiment of the invention may include a tube 10, with a wall 17, a longitudinal axis 18, and two ends 20, 22, each of which passes through an aperture 24, 26 in a sidewall 4, 5 of each fluidly connected vessel 2, 3. The tube 10 provides for a free flow of material between the connected vessels 2, 3, particularly as one of the vessels 2, 3 collects and accumulates the material.

The apertures 24, 26 may be drilled, formed, punched, or otherwise provided for fluidly connecting the vessels 2, 3, based on the constraints imposed by the structure, location, environment and configuration of the vessels 2, 3 to be joined. It is to be noted that any method of manufacture of the apertures 24, 26 may be utilized without deviating from the scope of the invention. For example, they may be drilled, molded, bored, punched, etc., into the sidewalls 4, 5 of the vessels 2, 3. Moreover, in keeping with the inventive scope, the diameters of the apertures 24, 26 need not satisfy any particular dimensions, but may be selected for any particular material flow characteristics desired.

The tube wall 17 may be fabricated of a material that provides a sealing interface against the apertures 24, 26 of the vessels 2, 3. Alternatively, the tube 10 may include a structure, such as a built-in flange or other sealing device, attached to or otherwise integrated with the tube wall 17 to provide a sealing interface between the tube wall 17 and each aperture 24, 26. Moreover, the inventive concept is not limited to a tube with two ends, for connecting only two vessels. To the contrary, the inventive scope contemplates a tube with three, four, five, six, seven or more ends, to connect up to as many vessels as there are tube ends. Such a tube may be configured as a hollow Y- or star-shaped apparatus with the necessary number of ends projecting from a hub that connects all or them.

Figure 4:
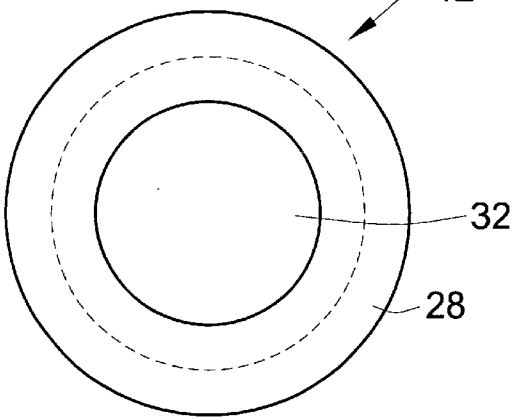
FIG. 4 is a plan view of the grommet component of the present invention.
Figure 9:
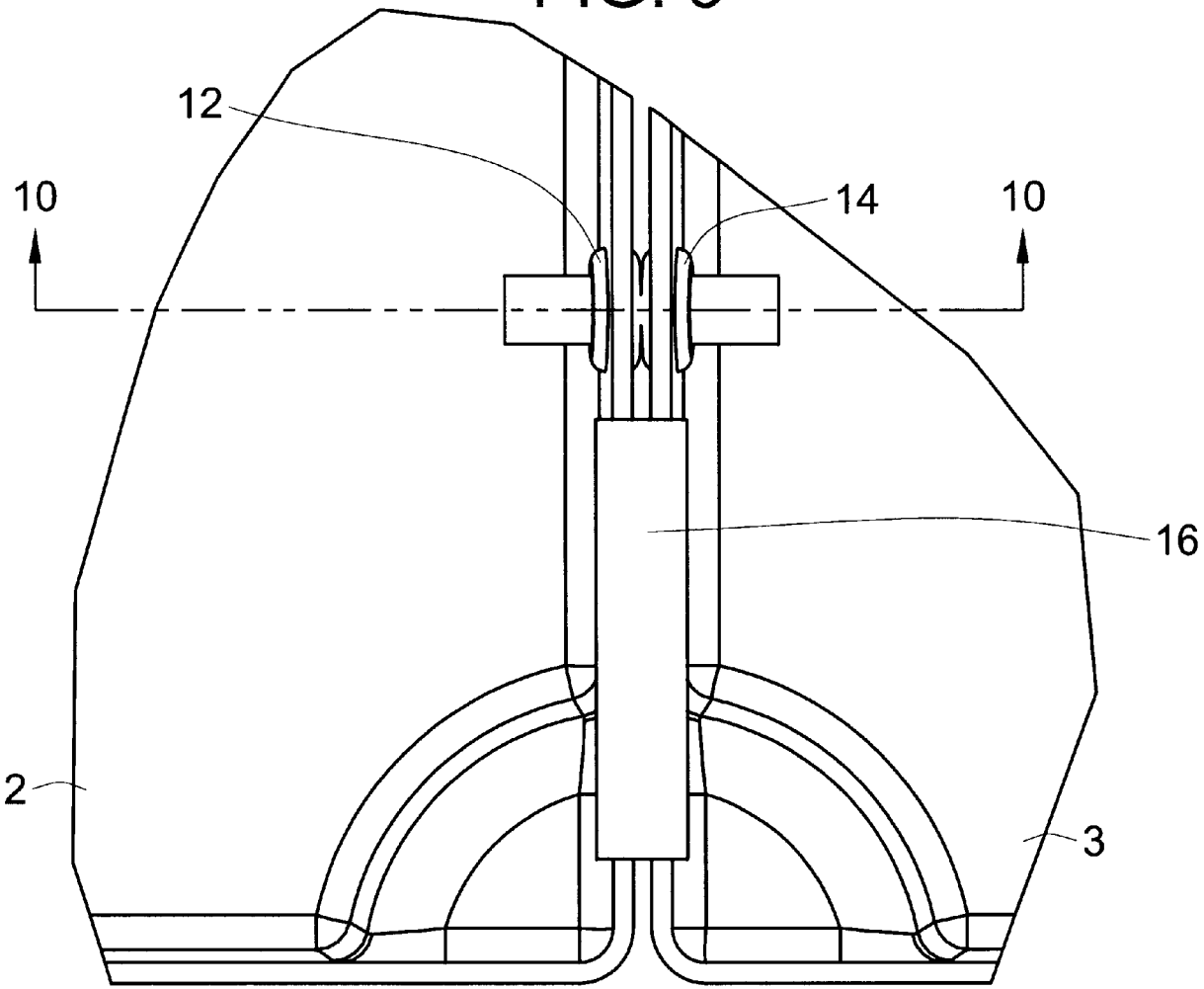
FIG. 9 is a top cutaway view of two vessels fluidly and structurally connected according to the teachings of an embodiment of the present invention.

Referring to FIG. 9, the invention may further include grommets 12, 14 installed into each aperture 24, 26 before the tube 10 is inserted therethrough, to seal or enhance the seal at the vessel sidewall apertures 24, 26 where the tube 10 passes through them. For secure insertion into the apertures 24, 26, each grommet 12 may be fabricated as a rubber plug 28 with a groove 30 and an inner bore 32, as seen in FIGS. 4 and 5. A bulbous flange 34, 36, may be disposed at each end of the plug 28, such that the outer diameter of each of the flanges 34, 36 is greater than the outer diameter of the groove 30. As shown in FIGS. 4 and 5, grommet 12 is representative of the grommets utilized in connection with a particular embodiment of the invention. Of course, alternative grommet structures may be employed in connection with the invention, without deviating from the inventive scope. For example, grommets incorporating a tapered configuration, or having only one, or no bulbous flanges may be used, among others. Additionally, in keeping with the inventive scope, the inner and outer diameters of the grommets need not satisfy any particular dimensions, but may be selected for their sealing performance based on the diameters of the tube 10 and apertures 24, 26.

As shown in FIG. 10, the grommets 12, 14 may be installed by inserting one flange 34, through a vessel sidewall aperture 24. Once the flange 34 is completely inserted, it emerges from the other side of the sidewall 4 such that both flanges 34, 36 sandwich the sidewall 4 in the vicinity of the aperture 24. Moreover, the grommets 12, 14 of this embodiment may be fabricated of a material resistant to corrosion or hazardous substance attack. However, many other types of polymeric or non-polymeric materials may be utilized, without deviating from the inventive scope. Ultimately, once grommets 12, 14 are inserted into the vessel sidewall apertures 24, 26, each end 20, 22 of the tube 10 may be inserted into an inner bore 32 of one of the grommets 12, 14, to provide an effective seal between the tube 10 and each vessel 2, 3. Depending on the construction of the grommet 12, it may provide multiple sealing surfaces. Specifically, as shown in FIG. 10, a bulbous flange 34 may seal against the proximate exterior 38 of sidewall 4, another bulbous flange 36 may seal against the proximate interior 39 of sidewall 4, and, as discussed in greater detail below, the grommet 12 may provide a coaxial seal between a portion 40 of the tube end 20 and the aperture 24. Of course, it is to be understood that the number of discrete seals provided by the grommet 12 is not limited to the number and type described herein, but may be any number or type consisted with the particular grommet construction. For example, a tapered grommet may provide one or two discrete seals. Alternately, but not limited hereto, a grommet construction without bulbous flanges may only provide a coaxial type seal.

To improve the sealing performance, the outer diameter of the groove 30 may be designed slightly larger than the diameter of the aperture 24, such that the aperture 24 bears on the groove 30 when a grommet 12 is installed. Moreover, the diameter of the inner bore 32 of a grommet 12 may have a smaller diameter than the outer diameter of the tube 10. Accordingly, the tube 10 and the aperture 24 may thus compress the grommet 12 between them, resulting in a tighter fit and improved sealing performance of the grommet 12.

Figure 11:
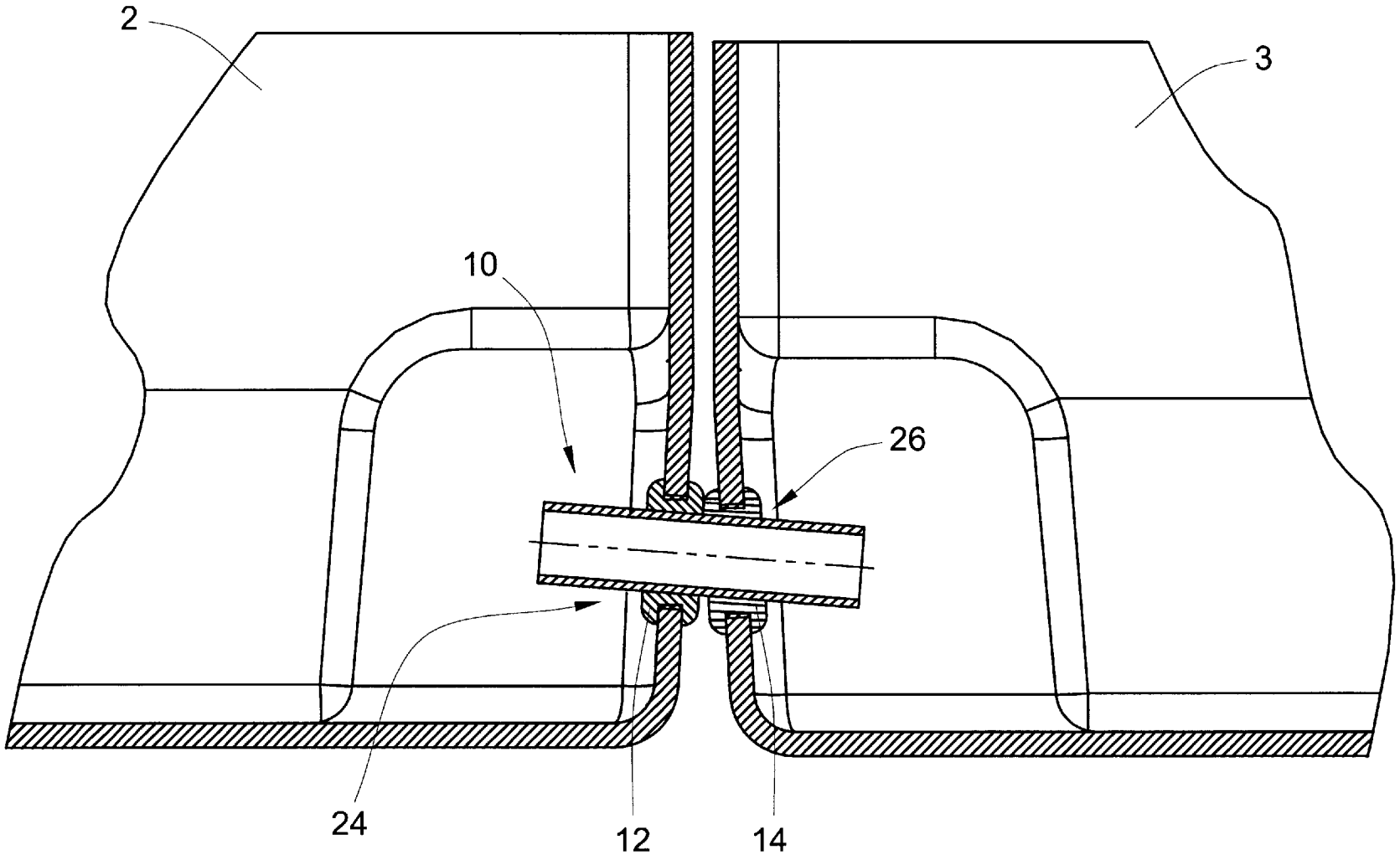
FIG. 11 is a sectional view, along line 10—10 of FIG. 9, showing two vessels fluidly connected according to the teachings of an embodiment of the present invention, wherein the vessels are at different vertical elevations relative to one another.

The grommets 12, 14 allow flexibility in application of the invention. When installed, they maintain at least one integral seal between the tube 10 and the respective aperture 24, 26, especially when the vessels 2, 3 are bumped or jostled. The flexibility of the grommets 12, 14 allows them to flex and absorb jolts, and also to maintain the integrity of the tube-to-aperture seal, even when the vessels 2, 3 sit on an uneven surface, or at different respective heights, as shown in FIG. 11.

Moreover, in contrast to the sealing method of the prior connection devices discussed above, the sealing interface of the present invention, whether facilitated by the grommets 12, 14, or features of or on the tube wall 17, forms a seal along the tube wall 17, throughout the aperture 24. Such a seal is coaxial to the longitudinal axis 18 of the tube 10, and the flexibility of the seal provides effective sealing even when the tube 10 is angled other than perpendicularly to the vessel sidewalls 4, 5, as shown in FIG. 11. This may occur, for example, when each vessel 2, 3 is disposed at a different vertical elevation relative to the other vessel due to an uneven shop floor, or when the vessel sidewalls 4, 5 are slightly angled other than normal to the tube 10. It is to be appreciated that, in keeping with the inventive scope, the flexibility of the sealing interface also maintains an effective seal when the tube 10 is exposed to shear loading in the horizontal direction. This may occur, for example, when one vessel is bumped or jostled relative to the other, in direction parallel to the surface upon which the vessels 2, 3 rest, but normal to the longitudinal axis 18 of the tube 10.

To facilitate insertion of a tube end 20, 22 into a tightly-fitting grommet 12, 14 that provides effective sealing, the opposite end may by tapped with a hammer, mallet or other similar blunt instrument. Moreover, the tube wall 17 may be partially or entirely fabricated of a material such as Teflon that inherently facilitates ease of insertion into the grommets 12, 14. Of course, the tube may be partially or entirely fabricated of many other materials, such as polymers, plastics, or metals, among others, without deviating from the inventive scope. Alternatively, tube wall 17 may also be at least partially coated with Teflon, or other lubricious coating, without deviating from the inventive scope. This allows the tube ends 20, 22 to be easily slid or tapped through the grommets 12, 14. However, the invention is not to be understood as limited to a coating applied to the tube wall 17 in order to reduce insertion effort.

In addition to providing a material transfer passage, the tube 10 of this embodiment may provide a secure connection between adjacent vessels 2, 3 in a direction transverse to the longitudinal axis 18 of the tube 10. Specifically, the material selection and relative shortness of the tube 10 may provide rigidity in order to prevent connected vessels 2, 3 from separating when a separating force acts on one or both of the vessels 2, 3 in this direction. It is to be noted, though, that a wide range of materials and tube lengths are contemplated within the inventive scope. Although the tube 10 of this embodiment may be composed of a non-metallic material and have a relatively short tube length, any suitable material, such as a metal, alloy, or other suitable composition can be used, and the tube 10 may have any practical length without deviating from the inventive scope. Moreover, the tube 10 may be fabricated of a material resistant to corrosion or hazardous substance attack.

The diameter of the tube 10 may be selected to optimize the material flow between the vessels. However, in accordance with the teachings of the invention, the tube diameter need not satisfy any particular dimension or flow rate, and may vary according to the desired flow characteristics and aperture diameters.

To structurally connect adjacent vessels 2, 3 along the longitudinal axis 18 of the tube 10, the apparatus, according to an embodiment of the present invention, may include one or more clips 16. As shown in FIG. 6, each clip 16 is a C-shaped channel member with two arms 42, 44 extending from a base member 46. Advantageously, the shape and design of the clip 16 reduces stresses on the vessel sidewalls 4, 5, especially in the area of the apertures 24, 26, since the clip 16 does not necessarily provide a structural connection in the immediate vicinity of the apertures 24, 26, as will be described below. As shown in FIG. 10, to secure adjacent vessels 2, 3 where, as in this embodiment, the grommets 12, 14 and tube 10 of the apparatus may have already been installed, the clip 16 may be fitted to straddle the substantially abutting top edges 48, 50 of the sidewalls 4, 5 of adjacent vessels 2, 3. Significantly, the length of the arms 42, 44 reduces stresses on the vessel sidewalls 4, 5, by dissipating any stresses over the area of the arm 42, 44. The stress reduction due to this clip 16 is particularly significant where, for example, heavy containers or drums 8 are shifted or rolled from one vessel to another.

It is to be appreciated that the length and area of the arms 42, 44 need not satisfy any particular dimensions, but may be selected, without deviating from the inventive scope, for structural connection and stress reduction properties, based on vessel sidewall and clip parameters such as material, thickness, etc. It is also to be noted that although the clip arms 42, 44 are approximately parallel in this embodiment, the distance and relationship between them may be modified to straddle adjacent sidewalls of various thicknesses, without deviating from the scope of the invention. Moreover, if the sidewalls 4, 5 are not parallel, the clip arms 42, 44 may be oriented at some angle to each other, to match that of adjacent sidewalls 4, 5, while still keeping within the inventive scope.

Figure 7:
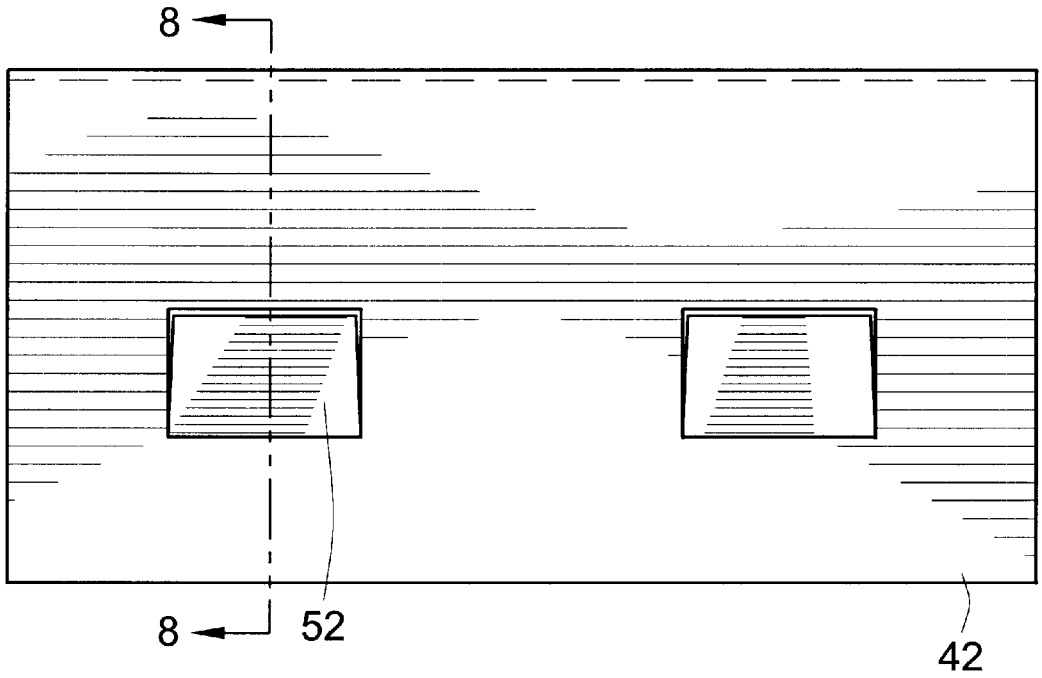
FIG. 7 is a side view of the clip component of the present invention, which is shown in FIG. 6.
Figure 8:
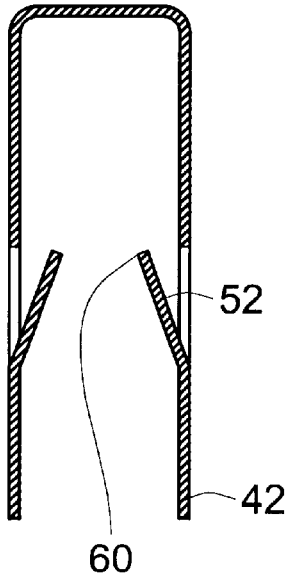
FIG. 8 is a sectional view, along line 8—8 of FIG. 7, of the clip component of the present invention.

To improve clip retention once a clip 16 is installed over the sidewalls 4, 5 of adjacent vessels 2, 3, each clip 16 may include one or more tabs of which tab 52, including a free end 60, is representative, as shown in FIGS. 6–8. In this embodiment, the tab 52 is rectangularly-shaped and is angled inwardly from the clip arm 42, such that the free end 60 is oriented toward the base member 46 and biased toward the interior of the clip 16. Thus, the inward inclination of the tab 52 allows the clip 16 to easily slide over the sidewalls 4, 5 of adjacent vessels 2, 3. However, the bias of the free end 60 toward the sidewall 4 provides resistance to removal of the clip 16 from adjacent sidewalls 4, 5, once the clip 16 is fitted, as seen in FIG. 10. Accordingly, the clip 16 provides a secure connection of adjacent vessels 2, 3, particularly along the direction of the longitudinal tube axis 18. This connection prevents leaks by biasing adjacent sidewalls 4, 5 toward each other such that the ends 20, 22 of the tube 10 do not pull out of their respective apertures 24, 26, particularly when a separating force is applied to one or both of the adjacent vessels 2, 3 in the direction of the longitudinal tube axis 18.

Moreover, it is to be appreciated that the tab 52 may be configured otherwise than described herein. For example, a tab 52 may be perforated in a clip arm 42, 44, but inwardly inclined only after the clip 16 is fitted over the sidewall top edges 48, 50. Each clip 16 may also include any number of tabs. For example, each clip 16 may include 2, 3, 4, 5 or more tabs, all disposed on only one clip arm, or randomly disposed on both clip arms 42, 44, without deviating from the inventive concept described herein.

Although the clip 16 may be most economically fabricated from a single material, the inventive scope contemplates a portion or portions of the clip 16 fabricated of other materials. Moreover, the clip 16 of this embodiment may be fabricated, at least partially, of a metal resistant to corrosion and hazardous substance attack. However, many other types of materials may be utilized, without deviating from the inventive scope. For example, the clip 16 may also be manufactured at least partially of a plastic, or other suitable polymer or non-polymer material.

In keeping with the inventive scope, the location of the clip 16, on the vessel sidewalls 4, 5 is somewhat variable relative to the tube 10 location, based on the environmental or physical constraints of the vessels 2, 3. For example, the clip position may be slightly varied from directly above the tube 10, along the sidewall edges 48, 50, to avoid any surface features of the sidewalls, or to better accommodate a grate spanning the vessel opening. Additionally, the clip position may be varied slightly to take advantage of a particularly rigid portion of the sidewalls 4, 5 near the tube position.

In addition to the apparatus described, the invention also contemplates a method of fluidly connecting vessels in order to provide for material transfer between them. This method comprises a sequence of steps. The first step of the method comprises determining a level at which the fluid connection for material transfer is desirable.

For example, if transfer is desired at a low level, such as where the material transferred cannot be allowed to accumulate, the apertures 24, 26 can be made near the bottoms of the vessels 2, 3. This would expedite removal and disposal of noxious materials that may quickly evaporate and contaminate the air, if allowed to accumulate. Alternatively, if the material collected is relatively benign, it may be desirable to allow it to accumulate in a primary vessel 2 before transfer to a secondary vessel 3. In this case, the apertures can be located higher up on the vessel sidewalls 4, 5.

Once the appropriate transfer level is determined, the next step of the method comprises providing an aperture 24, 26 in the sidewall 4, 5 of each vessel 2, 3 at the desired level. Then, according to the method, grommets 12, 14 may be inserted into the apertures 24, 26. After the grommets 12, 14 are inserted, each end 20, 22 of the tube 10 is forced into the inner bore of one of the grommets 12, 14. Alternatively, and without deviating from the inventive scope, if the tube 10 is fabricated of a material that provides a sealing interface against the apertures 24, 26, or if the tube 10 otherwise incorporates an interface to seal against the apertures 24, 26, the tube 10 may simply be inserted into the apertures 24, 26 without the grommets 12, 14. Moreover, if a tube end 20, 22 is difficult to insert, either into the grommets 12, 14, or the apertures 24, 26, it may be tapped in by striking the opposite end with a hammer, mallet or other similar blunt instrument. A C-shaped clip 16 may then be fitted to the top edges 48, 50 of the sidewalls 4, 5 of adjacent vessels 2, 3, to structurally connect them.

While this invention has been described with an emphasis upon an exemplary embodiment, variations of the exemplary embodiment can be used, and it is intended that the invention can be practiced otherwise than as specifically described herein. Accordingly, this invention includes all modifications encompassed within the spirit and scope of the invention as defined by the claims.

What is claimed is:

1. An apparatus for collecting and controlling the accumulation of fluids, comprising:

a first vessel including an interior for collecting fluids, at least one upright sidewall including a top edge, and at least one aperture in the sidewall;

a second vessel including an interior for collecting fluids, at least one upright sidewall including a top edge, and at least one aperture in the sidewall;

a tube including an outer wall and two opposing ends, with a first end of the tube being inserted through the aperture in the first vessel and a second end of the tube being inserted through the aperture in the second vessel, the tube providing a fluid connection between the first and second vessels;

a first sealing interface formed between a portion of the outer wall of the tube and the first aperture, wherein the sealing interface comprises a grommet that forms a substantially coaxial seal between the tube and the first aperture;

a second sealing interface formed between a portion of the outer wall of the tube and the second aperture, wherein the sealing interface comprises a grommet that forms a substantially coaxial seal between the tube and the second aperture;

a connecting member in the form of a C-shaped channel member adapted to be fitted over the top edges of substantially abutting sidewalls of adjacent vessels and to provide structural connection between adjacent vessels, the C-shaped channel member being separate from the tube and being capable of placement separately from the tube.

2. The apparatus of claim 1, wherein the tube outer wall further comprises, at least partially, a lubricious material.

3. The apparatus of claim 1, wherein at least a portion of the tube outer wall further comprises a lubricious coating.

4. The apparatus of claim 1, the C-shaped channel member further comprising two arm sections defining an interior, and a tab protruding into the interior of the channel member from an arm section.

5. The apparatus of claim 4, wherein the entire C-shaped channel member is fabricated of a single material.

6. The apparatus of claim 1, wherein the vessels comprise hazardous material containment pallets.

7. The apparatus of claim 1, wherein at least a portion of the tube is resistant to hazardous material attack.

8. The apparatus of claim 1, wherein the grommet is resistant to hazardous material attack.

9. The apparatus of claim 1, wherein the C-shaped channel member is resistant to hazardous material attack.

10. An apparatus for collecting and controlling the accumulation of materials within a plurality of vessels, each vessel having an interior for collecting material, each vessel further including an upright sidewall including a top edge and an aperture, the apparatus comprising:

a tube including an outer wall and a plurality of ends, the tube adapted to provide a fluid connection between the vessels, wherein each end is inserted through the aperture in one of the vessel sidewalls;

a sealing interface provided between a portion of the outer wall of a tube end and an aperture into which the tube end is inserted, such that the sealing interface forms a substantially coaxial seal between the tube and an aperture;

a connecting member in the form of a C-shaped channel member adapted to be fitted over the top edges of substantially abutting sidewalls of adjacent vessels, the C-shaped channel member being separate from the tube and being capable of placement separately from the tube.

11. The apparatus of claim 10, wherein the sealing interface comprises a grommet adapted to fit into the aperture of a vessel sidewall.

12. The apparatus of claim 10, wherein the tube further comprises, at least partially, a lubricious material.

13. The apparatus of claim 10, wherein at least a portion of the tube wall further comprises a lubricious coating.

14. The apparatus of claim 10, the C-shaped channel member further comprising two arm sections defining an interior, and a tab protruding into the interior of the channel member from an arm section.

15. The apparatus of claim 14, wherein the entire C-shaped channel member is fabricated of a single material.

16. The apparatus of claim 10, wherein the vessels comprise hazardous material containment pallets.

17. The apparatus of claim 10 wherein at least a portion of the tube is resistant to hazardous material attack.

18. The apparatus of claim 10 wherein at least a portion of the grommet is resistant to hazardous material attack.

19. The apparatus of claim 10, wherein at least a portion of the C-shaped channel member is resistant to hazardous material attack.

20. A method of fluidly connecting separate vessels, each vessel including an interior with a depth for collecting fluids and an upright sidewall including a top edge, the method comprising the steps of:

determining a depth of the interior of each vessel at which connection is desirable;

providing an aperture in the sidewall of each vessel at the desired depth;

providing a tube including an outer wall and two opposing ends;

inserting an end of the tube through the aperture in one of the vessels;

inserting another end of the tube through the aperture in another vessel, such that the tube provides a fluid connection between the vessels;

providing a sealing interface between each end of the tube and the aperture in each vessel sidewall, such that each sealing interface is substantially coaxial with the tube;

positioning the vessels such that the sidewalls are in a substantially abutting relationship, fitting a connecting member in the form of a C-shaped channel member over the top edges of the substantially abutting sidewalls of the adjacent vessels such that the channel member provides a structural connection between adjacent vessels, the C-shaped member further being separate from the tube, and being capable of placement separately from the tube.

21. The method of claim 20, wherein the step of providing a sealed interface comprises providing a grommet within each vessel aperture prior to inserting the tube into the aperture.

* * * * *